US011131954B2

(12) United States Patent
Harada et al.

(10) Patent No.: US 11,131,954 B2
(45) Date of Patent: Sep. 28, 2021

(54) IMAGE FORMING APPARATUS FOR DETERMINING IMAGE DEFECT

(71) Applicant: CANON KABUSHIKI KAISHA, Tokyo (JP)

(72) Inventors: Shingo Harada, Suntou-gun (JP); Hiroshi Hagiwara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/844,041

(22) Filed: Apr. 9, 2020

(65) Prior Publication Data

US 2020/0341422 A1 Oct. 29, 2020

(30) Foreign Application Priority Data

Apr. 26, 2019 (JP) ..... JP2019-085790

(51) Int. Cl.
*G03G 15/00* (2006.01)
*G03G 15/23* (2006.01)

(52) U.S. Cl.
CPC ..... *G03G 15/6573* (2013.01); *G03G 15/234* (2013.01); *G03G 15/5062* (2013.01); *G03G 2215/00945* (2013.01)

(58) Field of Classification Search
CPC ..... G03G 2215/00945
See application file for complete search history.

(56) References Cited

U.S. PATENT DOCUMENTS

| | | | | |
|---|---|---|---|---|
| 9,244,418 | B2 | 1/2016 | Yokoyama | |
| 9,811,042 | B2 | 11/2017 | Nakamura et al. | |
| 2014/0369702 | A1 | 12/2014 | Yokoyama | |
| 2016/0062296 | A1* | 3/2016 | Nakamura | G03G 15/5062 399/15 |
| 2017/0153566 | A1* | 6/2017 | Hashimoto | G03G 15/5029 |
| 2019/0278210 | A1* | 9/2019 | Sekita | G03G 15/55 |

FOREIGN PATENT DOCUMENTS

| | | |
|---|---|---|
| JP | 2010-041430 A | 2/2010 |
| JP | 2013-134450 A | 7/2013 |
| JP | 2015-001600 A | 1/2015 |
| JP | 2016-048309 A | 4/2016 |

* cited by examiner

*Primary Examiner* — Jennifer Bahls
(74) *Attorney, Agent, or Firm* — Venable LLP

(57) ABSTRACT

An image forming apparatus includes an image forming unit configured to form an image on a sheet; a reading unit configured to read the image formed on the sheet by the image forming unit during a period in which the sheet is being conveyed by a conveying unit; a control unit configured to control a conveyance speed of the sheet by the conveying unit; and a determination unit configured to determine whether or not there is an image defect in the image formed on the sheet by the image forming unit based on image data of a first partial image read by the reading unit, excluding a second partial image passing through the reading unit during a speed variation period in which the control unit varies the conveyance speed of the sheet.

14 Claims, 16 Drawing Sheets

IMAGE FORMING APPARATUS FOR DETERMINING IMAGE DEFECT

BACKGROUND OF THE INVENTION

Field of the Invention

The present invention relates to an image forming apparatus.

Description of the Related Art

There is proposed a configuration in which a contact image sensor (CIS) is provided in an image forming apparatus and an image is read by the CIS to detect an image defect. Further, in order to stably read an image, U.S. Patent Application Publication No. 2014-369702 discloses a configuration in which a conveyance speed of a medium is kept constant when reading an image formed on the medium.

For example, when an image formed on a sheet is read in order to determine an image defect, the image can be stably read by making the conveyance speed of the sheet be constant as disclosed in U.S. Patent Application Publication No. 2014-369702. However, at the time of image formation, the image forming apparatus causes the conveyance speed of the sheet to change due to various factors. Therefore, even if the conveyance speed of the sheet varies during image reading, it is necessary to suppress the influence of this variation and accurately determine the image defect.

SUMMARY OF THE INVENTION

According to an aspect of the present invention, an image forming apparatus includes: a conveying unit configured to convey a sheet; an image forming unit configured to form an image on the sheet; a reading unit configured to read the image formed on the sheet by the image forming unit in a duration where the sheet is being conveyed by the conveying unit; a control unit configured to control a conveyance speed of the sheet by the conveying unit; and a determination unit configured to determine whether or not there is an image defect in the image formed on the sheet by the image forming unit based on image data of a first partial image read by the reading unit, excluding a second partial image passing through the reading unit during a speed variation period in which the control unit varies the conveyance speed of the sheet.

Further features of the present invention will become apparent from the following description of exemplary embodiments with reference to the attached drawings.

DESCRIPTION OF THE EMBODIMENTS

Figure 1:
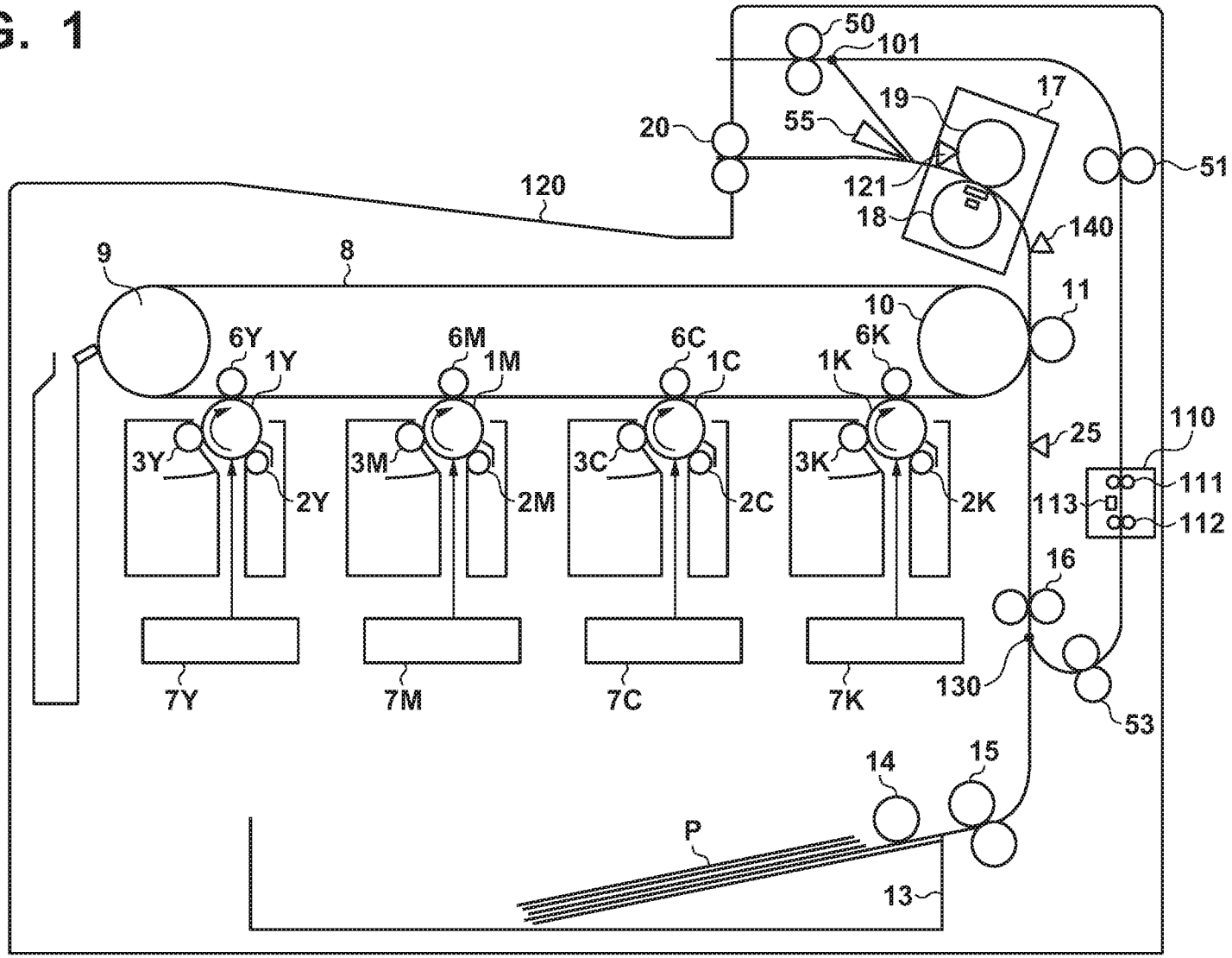
FIG. 1 is a configuration diagram of an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

FIG. 1 is a configuration diagram of an image forming apparatus according to the present embodiment. In each of the figures, Y, M, C, and K at the end of reference numerals indicate that the color of the toner formed by the corresponding member is yellow, magenta, cyan, and black, respectively. However, in the following description, when it is not necessary to distinguish colors, reference numerals in which trailing characters are omitted are used. A photosensitive member 1 is rotationally driven in the clockwise direction in the figure at the time of image formation. A charging roller 2 charges the surface of the corresponding photosensitive member 1 to a uniform potential. An exposure device 7 scans and exposes the corresponding photosensitive member 1 with light to form an electrostatic latent image on the photosensitive member 1. A developing roller 3 develops the electrostatic latent image of the corresponding photosensitive member 1 with toner of a corresponding color to form a toner image on the photosensitive member 1. A primary transfer roller 6 transfers the toner image of the corresponding photosensitive member 1 to an intermediate transfer belt 8 by the primary transfer bias. By superimposing the toner images formed on the respective photosensitive members 1 and transferring them to the intermediate transfer belt 8, a full-color toner image can be formed on the intermediate transfer belt 8.

The intermediate transfer belt 8, which is an image carrier, is stretched by a drive roller 9 and a secondary transfer opposing roller 10, and is driven to rotate in the counterclockwise direction in the figure following the rotation of the drive roller 9 during image formation. As a result, the toner image transferred to the intermediate transfer belt 8 is conveyed to a position (a transfer position) facing a secondary transfer roller 11. Meanwhile, a sheet P in a sheet feed cassette 13 is fed to a conveyance path by a feeding roller 14, and is conveyed to a position (transfer position) facing the secondary transfer roller 11 by a roller pair 15 and a registration roller pair 16. The secondary transfer roller 11 transfers the toner image of the intermediate transfer belt 8 onto the sheet P in accordance with a secondary transfer bias. A sensor 25 for detecting the sheet P is provided between the registration roller pair 16 and the secondary transfer roller 11. The sheet P onto which the toner image has been transferred is conveyed to a fixing unit 17. A sensor 140 for detecting the sheet P is provided between the secondary transfer roller 11 and the fixing unit 17. The fixing unit 17 heats and pressurizes the sheet P by a heating roller 18 and a pressure roller 19 to fix the toner image on the sheet P. The fixing unit 17 includes a sensor 121 that detects the sheet P after fixing. When an image is formed on only one side of the sheet P, after the toner image is fixed, the sheet P is discharged to a discharge tray 120 by discharge rollers 20. At this time, a flapper 55 is set at a position where the sheet P is conveyed toward the discharge rollers 20.

On the other hand, when forming images on both sides of the sheet P, after a toner image formed on one side is fixed, the sheet P is conveyed in a direction toward a double-sided reversing position 101 downstream of the transfer position in the conveyance direction of the sheet P by setting the flapper 55. At a predetermined timing after the trailing edge of the sheet P passes through the double-sided reversing position 101, the reversing roller pair 50 is driven to rotate in the opposite direction to that before. As a result, the sheet P is conveyed in the direction of the double-sided conveyance path. The timing at which the reversing roller pair 50 is reversely rotated is determined by the time from when the sensor 121 detects the trailing edge of the sheet P to when the trailing edge of the sheet P is conveyed to a predetermined position where the sheet P has passed through the double-sided reversing position 101. In the double-sided conveyance path, the sheet P is conveyed by double-sided roller pairs 51 and 53, and thereafter, the sheet P is conveyed to the position facing the secondary transfer roller 11 again via a joining position 130 upstream of the transfer position. In this manner, the double-sided conveyance path is a conveyance path that connects the double-sided reversing position 101 and the joining position 130 in order to form images on both sides of the sheet. In the present embodiment, an image reading unit 110 is provided between the double-sided roller pair 51 and the double-sided roller pair 53. The image reading unit 110 includes first conveying rollers 111 and second conveying rollers 112, and a CIS 113 which is a reading unit provided between the two pairs of conveying rollers.

Figure 2:
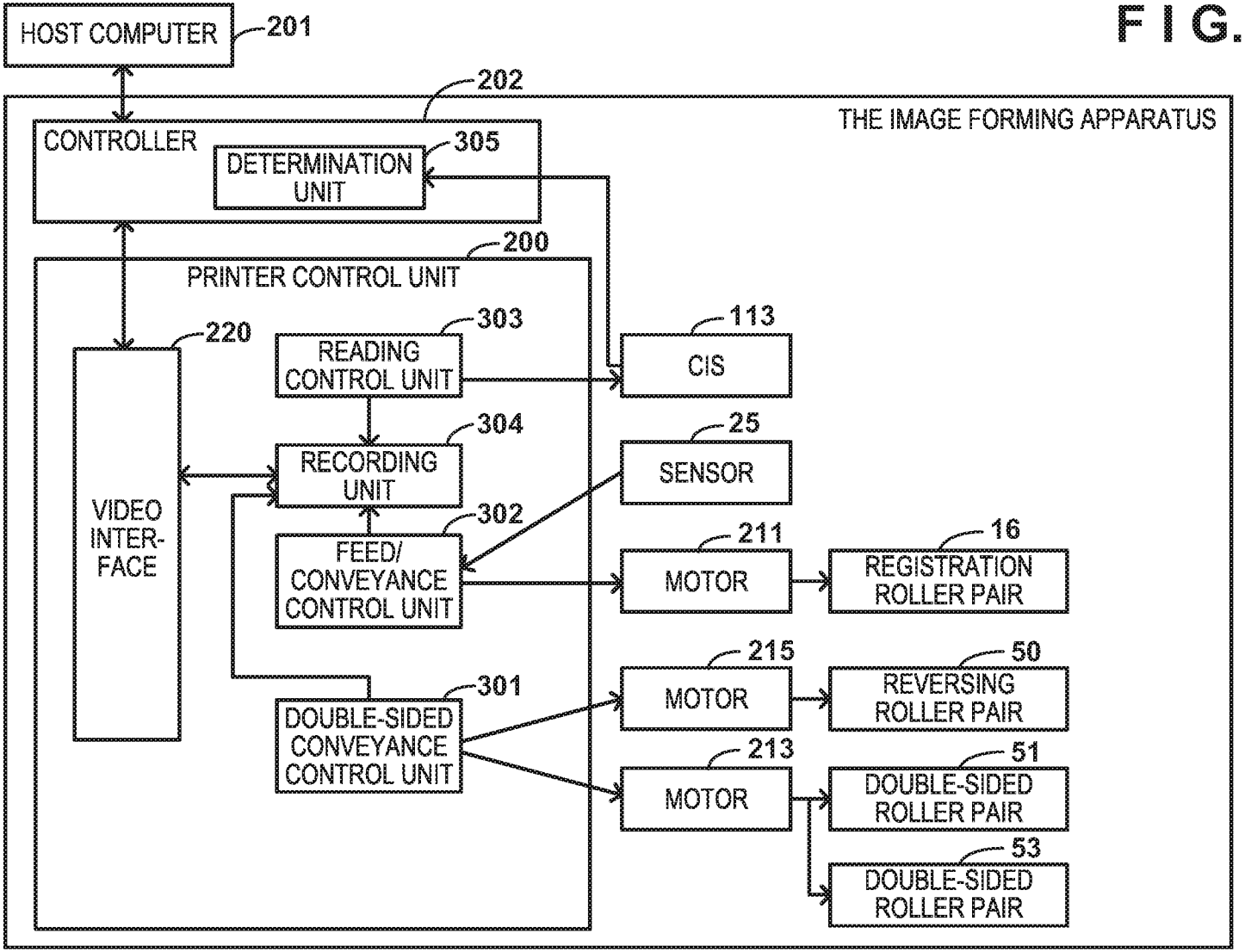
FIG. 2 is a control configuration diagram of an image forming apparatus according to an embodiment.

FIG. 2 is a control configuration diagram of an image forming apparatus according to the present embodiment. FIG. 2 shows only portions necessary for the description of the present embodiment. When a controller 202 receives image data and an image forming command for the image data from a host computer 201, the controller 202 outputs the image data to a printer control unit 200 through a video interface 220 and performs an image forming instruction. The printer control unit 200 includes a reading control unit 303, a recording unit 304, a feed/conveyance control unit 302, and a double-sided conveyance control unit 301. The printer control unit 200 includes a CPU and a memory, and when the CPU executes an appropriate program, the printer control unit 200 operates as the reading control unit 303, the recording unit 304, the feed/conveyance control unit 302, and the double-sided conveyance control unit 301. The feed/conveyance control unit 302 controls a motor 211 to control the rotation of the registration roller pair 16. A detection result of the sensor 25 is inputted to the feed/conveyance control unit 302. The double-sided conveyance control unit 301 controls the rotation of the reversing roller pair 50 by controlling a motor 215, and controls the rotation of the double-sided roller pairs 51 and 53 by controlling a motor 213.

The reading control unit 303 notifies the CIS 113 of a reading start timing for starting reading of an image and of a reading end timing for ending reading of the image. The reading control unit 303 also notifies the recording unit 304 of the reading start timing and the reading end timing notified to the CIS 113. Further, the reading control unit 303 notifies the controller 202 of the reading start timing and the reading end timing via the CIS 113 or the video interface 220. The CIS 113 reads the image formed on the sheets P in a duration from the reading start timing to the reading end timing. The CIS 113 outputs image data of the read image to a determination unit 305 of the controller 202. In addition, the feed/conveyance control unit 302 and the double-sided conveyance control unit 301 notify the recording unit 304 of the variation start timing at which the speed variation control of the motor 211 or the motor 213 is started and the variation end timing at which the speed variation control ends. The recording unit 304 determines and records variation period information indicating a period from the variation start timing to the variation end timing that is within the period from the reading start timing to the reading end timing notified from the reading control unit 303. Then, the recording unit 304 notifies the determination unit 305 of the variation period information via the video interface 220. The determination unit 305 determines, based on the variation period information, whether or not the image read by the CIS 113 has an image defect.

Figure 3C:
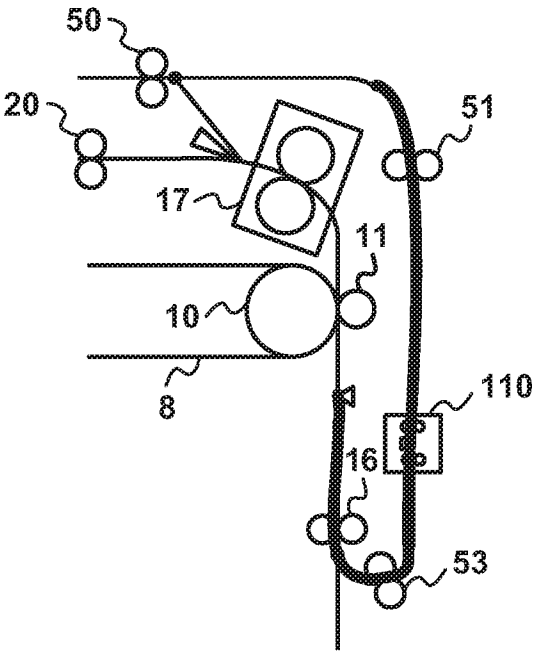
FIGS. 3A to 3C are views for describing sheet conveyance control according to an embodiment.
Figure 3B:
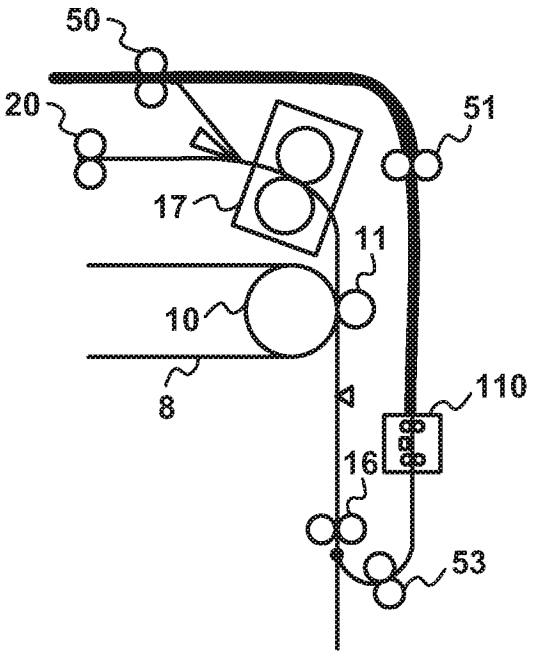
Figure 3A:
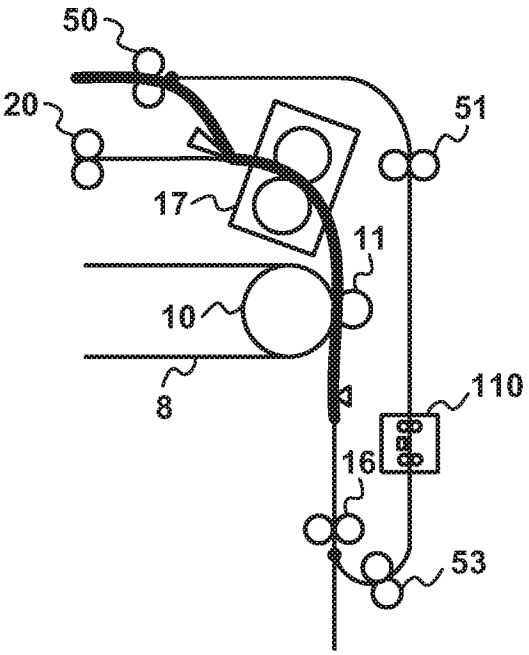
Figure 4B:
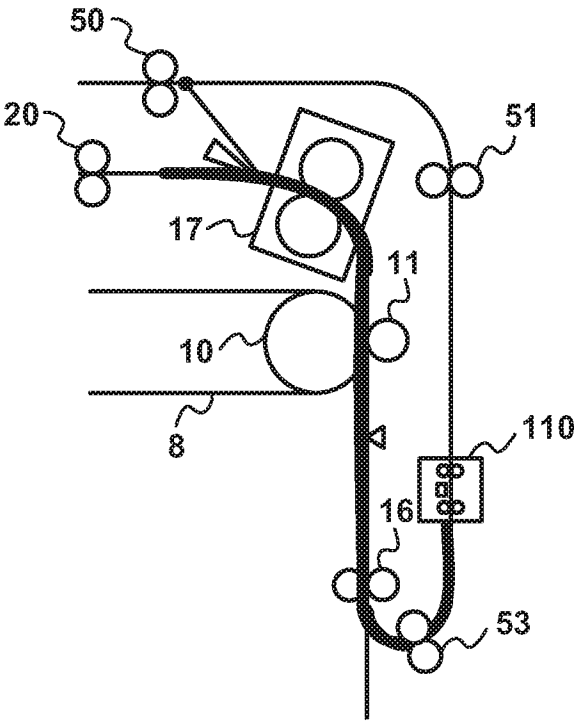
FIG. 4A and FIG. 4B are views for describing sheet conveyance control according to an embodiment.
Figure 4A:
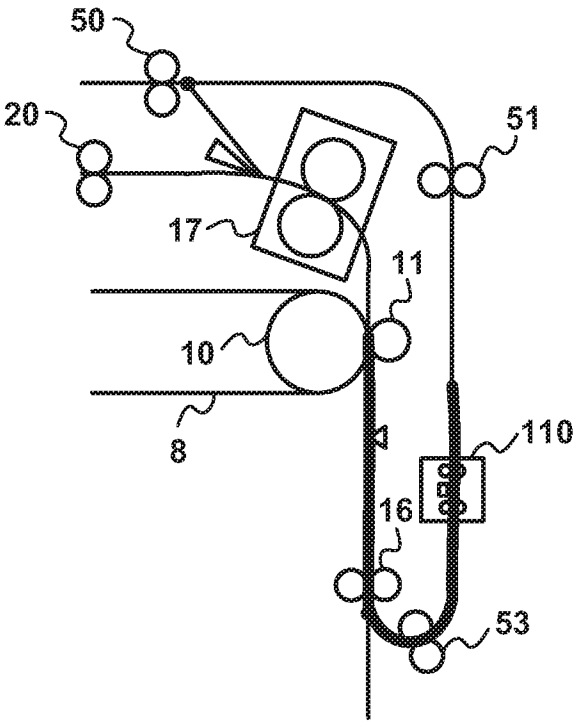

FIGS. 3A to 3C and FIG. 4A and FIG. 4B are views for describing the sheet conveyance control according to the present embodiment. In the following description, the surface of the sheet P on which an image is first formed is referred to as a first surface, and the surface of the sheet P on which an image is subsequently formed is referred to as a second surface. FIG. 3A shows a state in which the sheet P is conveyed by the reversing roller pair 50 during the formation of an image on the first surface. As described above, after the trailing edge of the sheet P reaches the double-sided reversing position 101, the double-sided conveyance control unit 301 rotates the reversing roller pair 50 in an opposite direction to that before. As a result, the sheet P is conveyed in the direction of the double-sided conveyance path. FIG. 3B shows a state where the leading edge of the sheet P has reached the image reading unit 110. The reading control unit 303 causes the image reading unit 110 to start reading an image of the sheet P, for example, using the present timing as the reading start timing. The reading start timing is determined, for example, by dividing the distance between the leading edge position after the reverse rotation of the sheet P when the reverse rotation of the reversing roller pair 50 is started and the leading edge position of the sheet P when the image reading unit 110 starts reading the sheet P by the conveyance speed of the sheet P. FIG. 3C shows a state where the leading edge of the sheet P has reached the detection position of the sensor 25. Note that, in the state of FIG. 3C, the image reading unit 110 is reading an image of the sheet P. The sensor 25 notifies the feed/conveyance control unit 302 that the leading edge of the sheet P has been detected. Thereby, the double-sided conveyance control unit 301 and the feed/conveyance control unit 302 start the speed variation control. In addition, the feed/conveyance control unit 302 notifies the recording unit 304 of the variation start timing. The speed variation control is performed to cause the sheet P to reach the transfer position in alignment with the timing at which the toner image of the intermediate transfer belt 8 which is to be transferred to the second surface reaches the transfer position. FIG. 4A shows a state where the leading edge of the sheet P has reached the transfer position. At this timing, the double-sided conveyance control unit 301 and the feed/conveyance control unit 302 end the speed variation control, and control the conveyance speed of the sheet P to be the same as that of the intermediate transfer belt 8. That is, FIG. 4A shows the variation end timing Note that the feed/conveyance control unit 302 determines that the variation end timing is reached when the sheet P is conveyed in accordance with the conveyance distance of the sheet P, more specifically, by the distance between the sensor 25 and the transfer position. As a result, the toner image is stably transferred onto the second surface of the sheet P. FIG. 4B shows a timing at which the trailing edge of the sheet P has been released from the image reading unit 110. The reading control unit 303 sets this timing as the reading end timing. The reading control unit 303 can determine the reading end timing based on the conveyance distance of the sheet P from the reading start timing.

Figure 5:
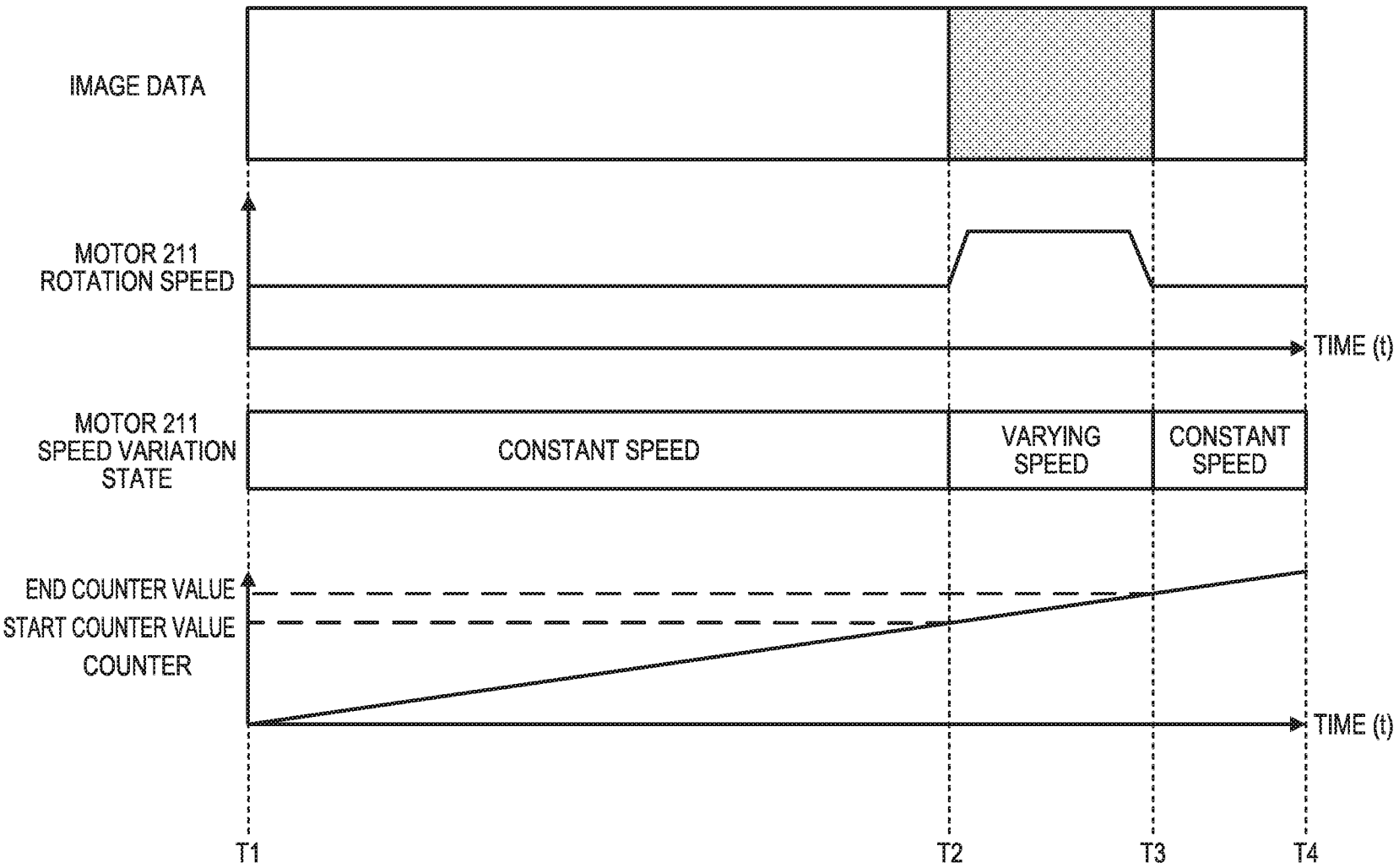
FIG. 5 is a diagram showing a rotation speed of a motor and a counter value in sheet conveyance control according to an embodiment.

FIG. 5 shows temporal change in the rotation speed of the motor 211 during reading of an image by the image reading unit 110. A time T1 is the timing of FIG. 3B, that is, the reading start timing A time T2 is the timing of FIG. 3C, that is, the variation start timing A time T3 is the timing of FIG. 4A, that is, the variation end timing. From a time T2 to a time T3, the conveyance speed of the sheet P is adjusted in accordance with the timing at which the toner image of the intermediate transfer belt 8 reaches the transfer position. In this example, the conveyance speed of the sheet P is increased, and thus the rotation speed of the motor 211 is also increased. A time T4 is the timing of FIG. 4B, that is, the reading end timing.

As shown in FIG. 5, in a duration between the time T1 and the time T2 and in a duration between the time T3 and the time T4, the conveyance speed of the sheet P is constant, and the image reading unit 110 can perform stable image reading. In contrast, in a duration between the time T2 and the time T3, the conveyance speed of the sheet P varies, so that the image reading unit 110 cannot perform stable image reading. The image data of FIG. 5 is data of an image read by the image reading unit 110, and a shaded part indicates partial data of a part of the image data which was not stably read. The variation period information recorded by the recording unit 304 is information specifying a period from the time T2 to the time T3 in FIG. 5. Note that the counter of FIG. 5 is a counter for specifying the speed variation period indicated by the variation period information, and is provided in both the recording unit 304 and the determination unit 305. Details of the counter will be described later.

Figure 6:
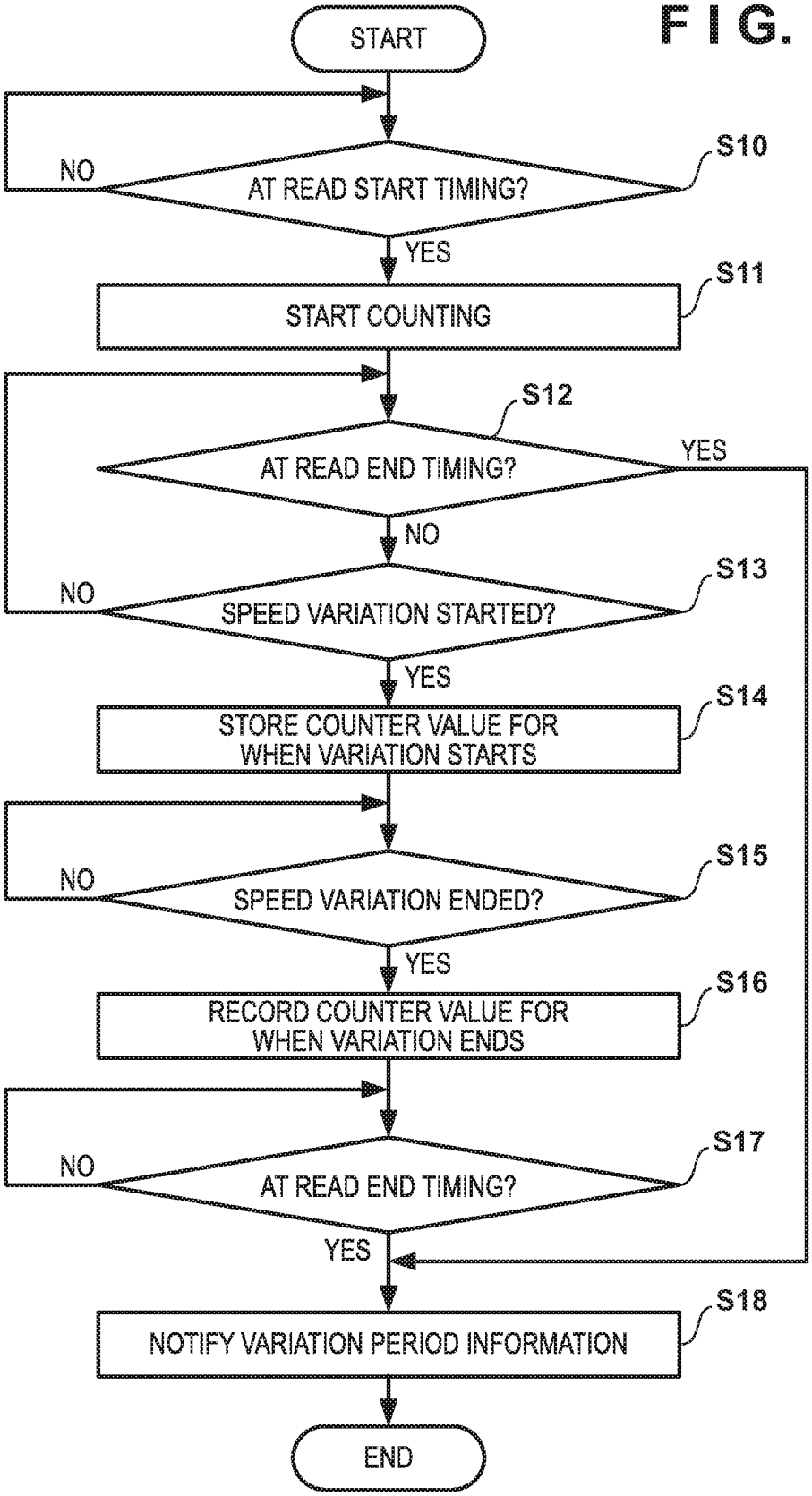
FIG. 6 is a flowchart of processing in a recording unit according to an embodiment.

FIG. 6 is a flowchart of count processing executed by the recording unit 304. In step S10, the recording unit 304 waits until a reading start timing is notified from the reading control unit 303. When a reading start timing is notified, in step S11, the recording unit 304 starts counting by the counter, and in step S12 the recording unit 304 determines whether a reading end timing is notified from the reading control unit 303. If a reading end timing is not notified from the reading control unit 303, the recording unit 304 determines whether a variation start timing is notified from the feed/conveyance control unit 302 in step S13. If a variation start timing is not notified, the recording unit 304 repeats the processing from step S12.

In contrast, when the variation start timing is notified in step S13, in step S14, the recording unit 304 records the counter value when the variation start timing was notified as a start counter value, and in step S15, waits until a variation end timing is notified from the feed/conveyance control unit 302. When the variation end timing is notified, in step S16, the recording unit 304 records the counter value when the variation end timing was notified as an end counter value. Subsequently, in step S17, the recording unit 304 waits until a reading end timing is notified from the reading control unit 303. When the reading end timing is notified, the recording unit 304 stops counting by the counter, and notifies the determination unit 305 of the start counter value recorded in step S14 and the end counter value recorded in step S16 as the variation period information in step S18. The speed variation period is a period from the counter value recorded in step S14 to the counter value recorded in step S16. Meanwhile, when the reading end timing is notified in step S12, in step S18, the recording unit 304 notifies the determination unit 305 of the variation period information indicating that the speed variation period is 0, in other words that there is no speed variation period, as the variation period information.

Figure 7:
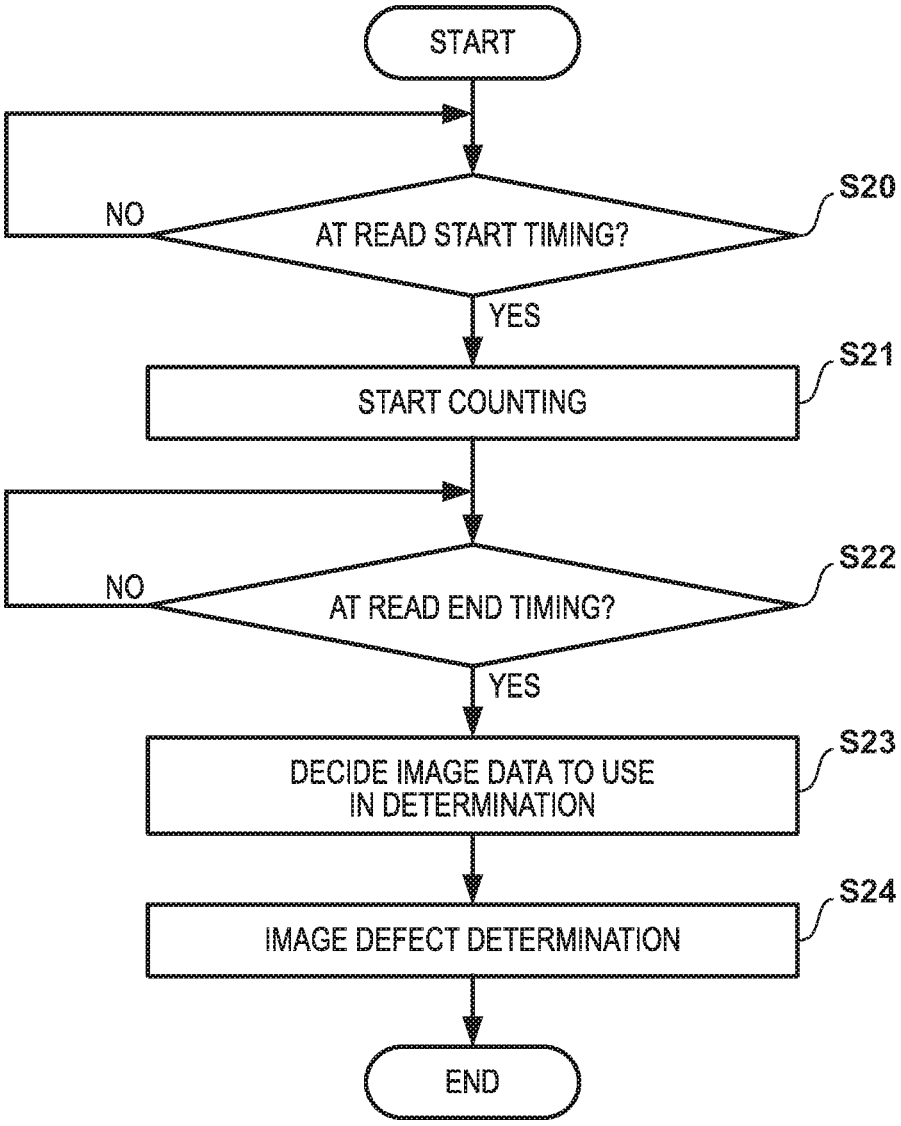
FIG. 7 is a flowchart of processing in a determination unit according to an embodiment.

FIG. 7 is a flowchart of count processing executed by the determination unit 305. In step S20, the determination unit 305 waits until the reading start timing is notified from the reading control unit 303. When the reading start timing is notified, the determination unit 305 starts counting by the counter in step S21. The counter included in the determination unit 305 and the counter included in the recording unit 304 are synchronized, and the counting speed is the same. That is, for example, the counter included in the determination unit 305 and the counter included in the recording unit 304 count the time based on the same clock. In step S22, the determination unit 305 waits until the reading end timing is notified from the reading control unit 303. Note that the image reading unit 110 outputs partial data to the determination unit 305 every time a part of an image is read in the duration from the reading start timing to the reading end timing. In the present embodiment, the partial data is data of a part of the image data corresponding to the image read by the image reading unit 110 in a duration from the reading start timing to the reading end timing. The image reading unit 110 sequentially reads parts of the image formed on the sheet P in accordance with the conveyance of the sheet P, and outputs the read partial data to the determination unit 305. When the partial data is inputted from the image reading unit 110, the determination unit 305 associates the counter value at that time with this partial data. When the reading end timing is notified from the reading control unit 303, the determination unit 305 stops counting by the counter in step S23. In addition, based on the variation period information notified from the recording unit 304, first partial data read during the speed variation period is determined from the image data received from the image reading unit 110. Then, second partial data that is from the image data received from the image reading unit 110 and excludes the first partial data is decided as image data to be used for the determination of an image defect. Then, based on the image data determined in step S23, the determination unit 305 determines whether or not the image formed on the sheet P has an image defect in step S24.

For example, in FIG. 5, a counter value indicated by a solid line increasing with time indicates a counter value counted by the determination unit 305. The start counter value and the end counter value of FIG. 5 are recorded by the recording unit 304 and notified to the determination unit 305 as described above. The determination unit 305 determines, as the first partial data, partial data in which the associated counter value is within the range of the start counter value to the end counter value, out of the partial data received from the image reading unit 110. The shaded portion of the image data in FIG. 5 indicates the first partial data. Then, the determination unit 305 determines whether or not an image defect has occurred based on the second partial data which is not the first partial data.

As described above, the determination unit 305 does not use the image data read by the image reading unit 110 for image determination while the speed variation control of the conveyance speed of the sheet P is being performed. By making an image determination based on the image data read by the image reading unit 110 while the conveyance speed of the sheet P is constant, it is possible to suppress erroneous determination that an image defect or the like has occurred, and to perform determination with good accuracy.

For example, a phenomenon called a vertical streak in which streak-like noise not present in an original image is formed on the sheet P can occur. Here, if the determination is performed using the image data read during the period in which the speed variation control of the sheet P is performed, there is a possibility that it will be erroneously determined that a vertical streak has occurred even in an image without a vertical streak. Therefore, in the case where a vertical streak is regarded as an image defect that is a determination target, the risk of erroneous determination can be reduced by performing the determination based on the image data for the period in which the speed variation control of the sheet P is not performed. On the other hand, a phenomenon called toner fogging can occur in which toner adheres to a region of the sheet P which should be a blank spot (a non-image region) and the density becomes high. However, toner fogging does not affect the determination result even in a case of using the image data for the period in which the speed variation control of the sheet P was performed. Therefore, in the case where the toner fogging is regarded as an image defect that is a determination target, the risk of erroneous determination does not become high even in a case of using the image data of the period in which the speed variation control of the sheet P was performed. In this manner, the determination unit 305 can be configured to determine whether or not the image data read in a period where the speed variation control of the sheet P was being performed is used for the determination in accordance with the type of the image defect that is a determination target.

It is possible to have the reading start timing be, for example, when the leading edge of the sheet P reaches the first conveying rollers 111, and have the reading end timing be, for example, when the trailing edge of the sheet P is released from the second conveying rollers 112. Further, at the timing when the leading edge of the sheet P reaches the first conveying rollers 111 or at the timing when the trailing edge of the sheet P is released from the second conveying rollers 112, the conveyance speed of the sheet P can unintentionally vary due to contact between the sheet and a roller or release from the contact. Therefore, the reading start timing can be, for example, a predetermined timing after the leading edge of the sheet P has reached the first conveying rollers 111 and before the leading edge of the sheet P reaches the CIS 113 reading position. The reading end timing can be, for example, a predetermined timing after the trailing edge of the sheet P is released from the second conveying rollers 112.

In the present embodiment, although the determination unit 305 is provided in the controller 202, configuration can be made such that the determination unit 305 is provided in the printer control unit 200. In addition, the printer control unit 200 can be configured to notify the determination unit 305 of the variation start timing and the variation end timing. In these cases, the recording unit 304 can be omitted.

Second Embodiment

Figure 8:
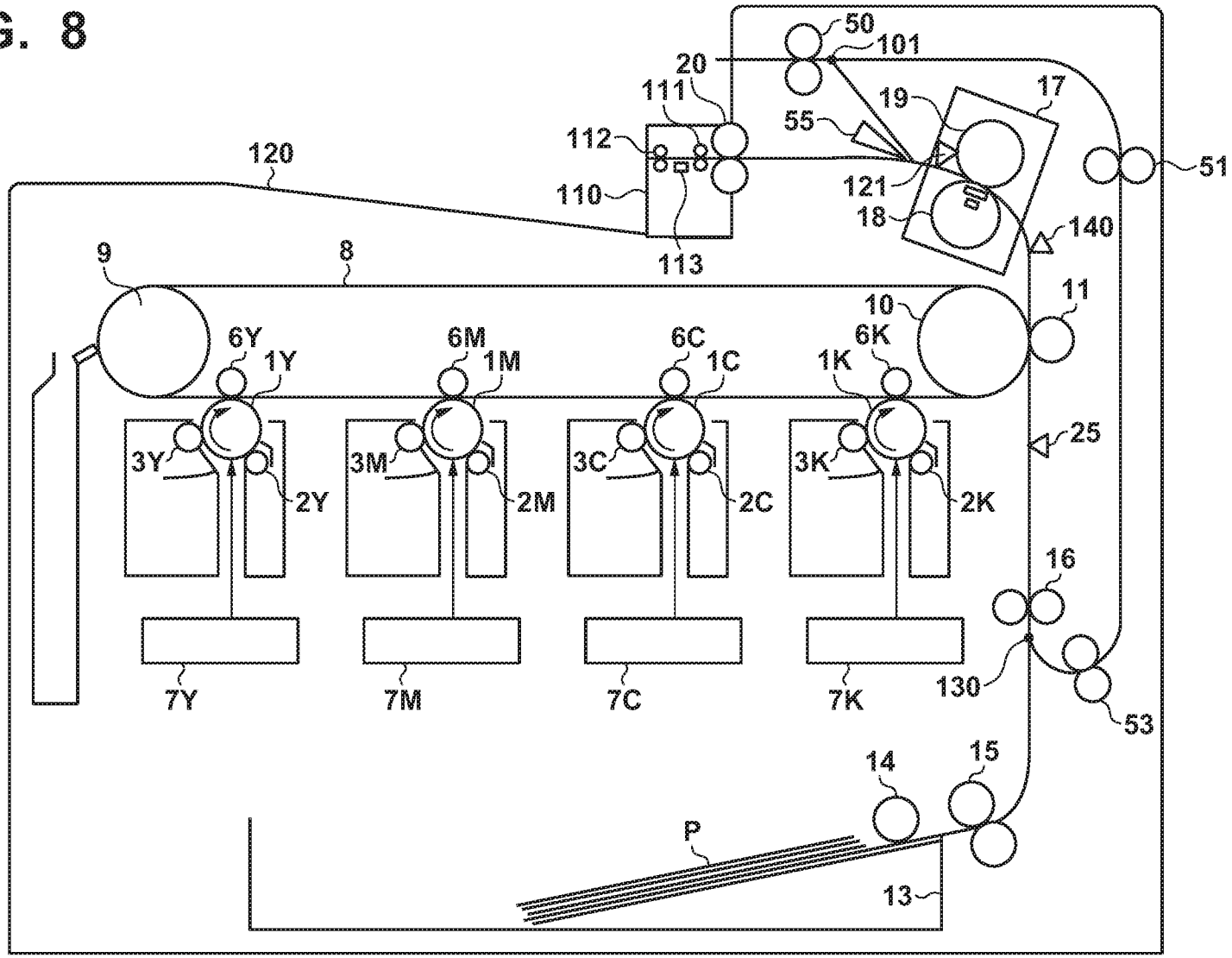
FIG. 8 is a configuration diagram of an image forming apparatus according to an embodiment.

Next, a second embodiment will be described focusing on differences from the first embodiment. FIG. 8 illustrates an image forming apparatus according to the present embodiment. The only difference from the image forming apparatus of the first embodiment is that the image reading unit 110 is provided downstream of the fixing unit 17, and more specifically, downstream of the discharge rollers 20.

Figure 9:
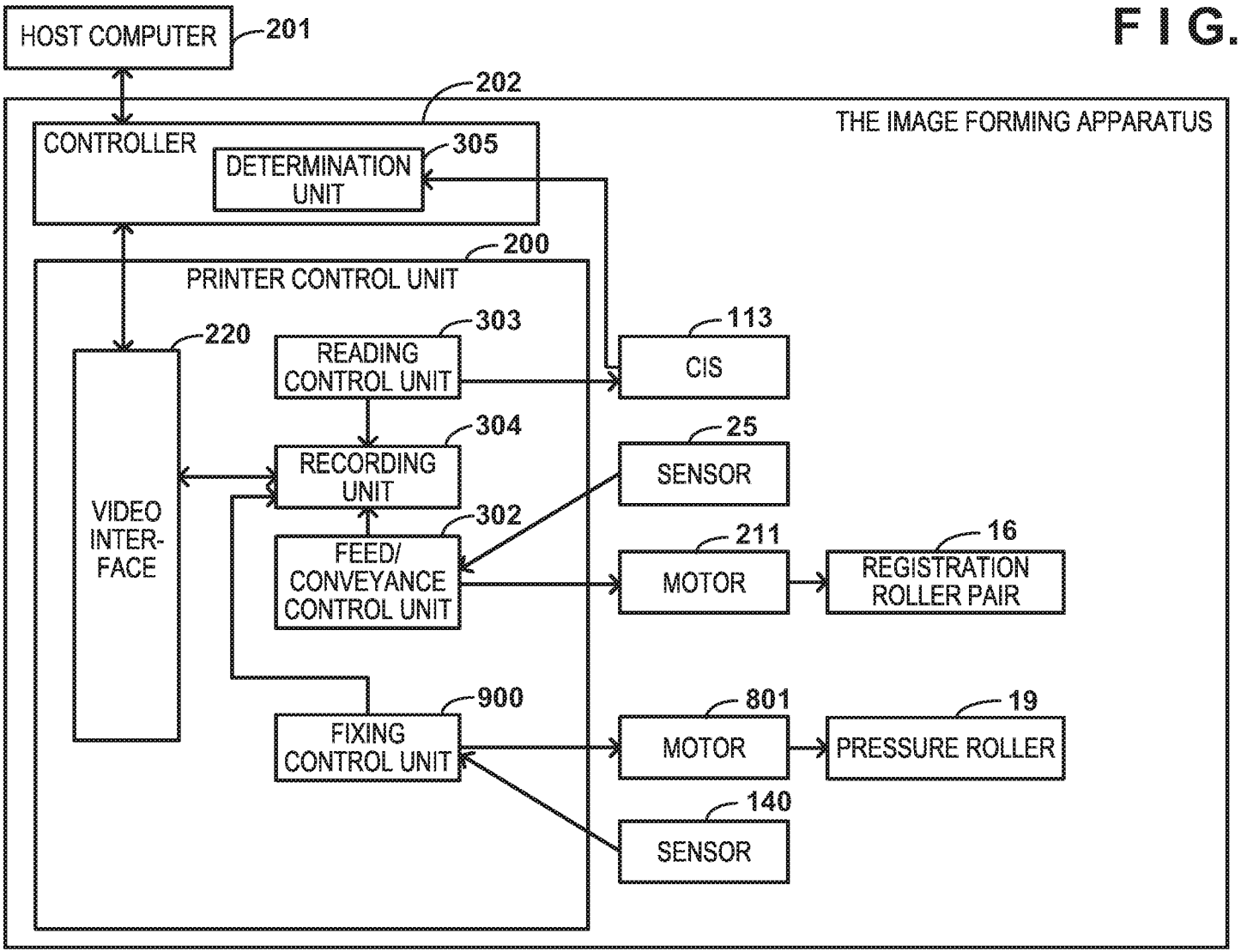
FIG. 9 is a control configuration diagram of an image forming apparatus according to an embodiment.

FIG. 9 is a control configuration diagram of an image forming apparatus according to the present embodiment. FIG. 9 shows only portions necessary for the description of the present embodiment. Description of constituent elements described in the first embodiment is omitted. A fixing control unit 900 controls a motor 801 to control the rotation of the pressure roller 19. A detection result of the sensor 140 is inputted to the fixing control unit 900. The fixing control unit 900 performs speed variation control (hereinafter referred to as warp control) for varying the speed of the motor 801 based on the detection result of the sensor 140 in order to form a fixed warp in the sheet P between the secondary transfer roller 11 and the fixing unit 17. The warp control is performed in order to prevent tension from being generated with respect to the sheet P during image formation due to a speed difference between the pressure roller 19 and the secondary transfer roller 11, thereby temporarily changing the speed of the intermediate transfer belt 8. If the speed of the intermediate transfer belt 8 temporarily changes, an image defect can occur when the toner image is transferred onto the intermediate transfer belt 8 or when the toner image is transferred from the intermediate transfer belt 8 to the sheet P.

Figure 10A:
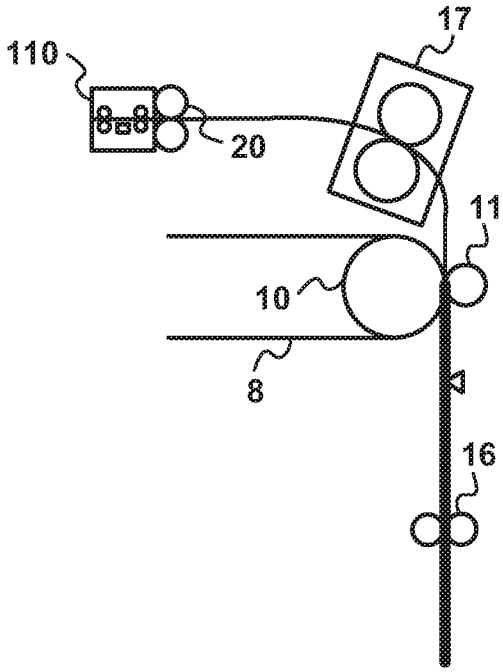
FIG. 10A to FIG. 10D are views for describing sheet conveyance control according to an embodiment.
Figure 10B:
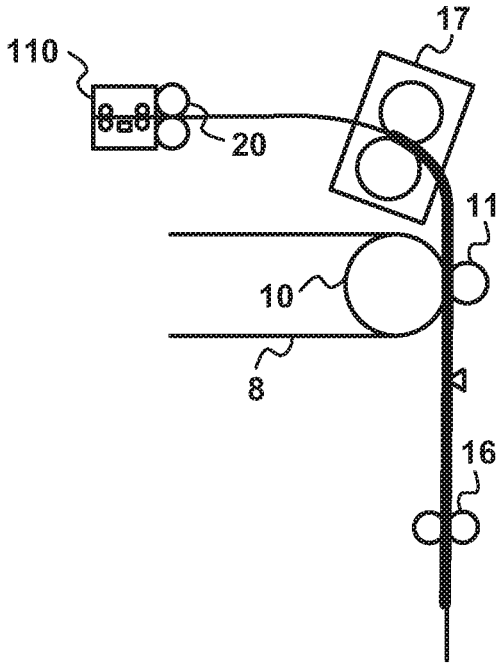
Figure 10C:
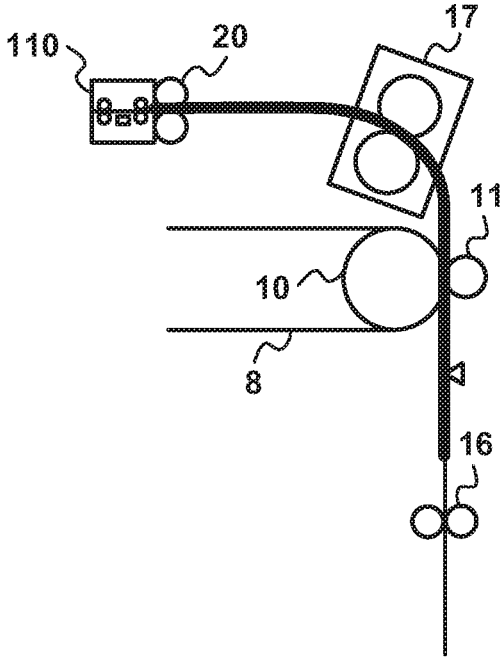
Figure 10D:
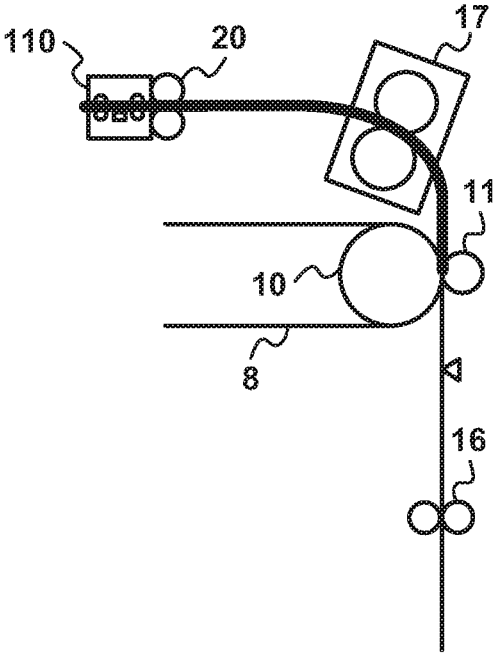

FIG. 10A to FIG. 10D are views for describing sheet conveyance control according to the present embodiment. FIG. 10A shows a timing at which the leading edge of the sheet P has reached the secondary transfer roller 11. FIG. 10B shows a timing at which the leading edge of the sheet P reaches the pressure roller 19, and the fixing control unit 900 starts the warp control from this timing That is, FIG. 10B shows the variation start timing. The fixing control unit 900 determines the variation start timing based on the conveyance distance of the sheet P after the sensor 140 detects the sheet P, and notifies the recording unit 304 of the variation start timing. FIG. 10C shows a reading start timing at which the leading edge of the sheet P has reached the image reading unit 110. The reading control unit 303 determines the reading start timing based on the conveyance distance of the sheet P after the sensor 121 detects the sheet P. FIG. 10D shows the timing at which the trailing edge of the sheet P has been released from the position of the secondary transfer roller 11, and the fixing control unit 900 ends the warp control from this timing That is, FIG. 10D shows the variation end timing. The fixing control unit 900 determines the variation end timing in accordance with the conveyance distance of the sheet P from the variation start timing for example, and notifies the recording unit 304 of the variation end timing.

Figure 11:
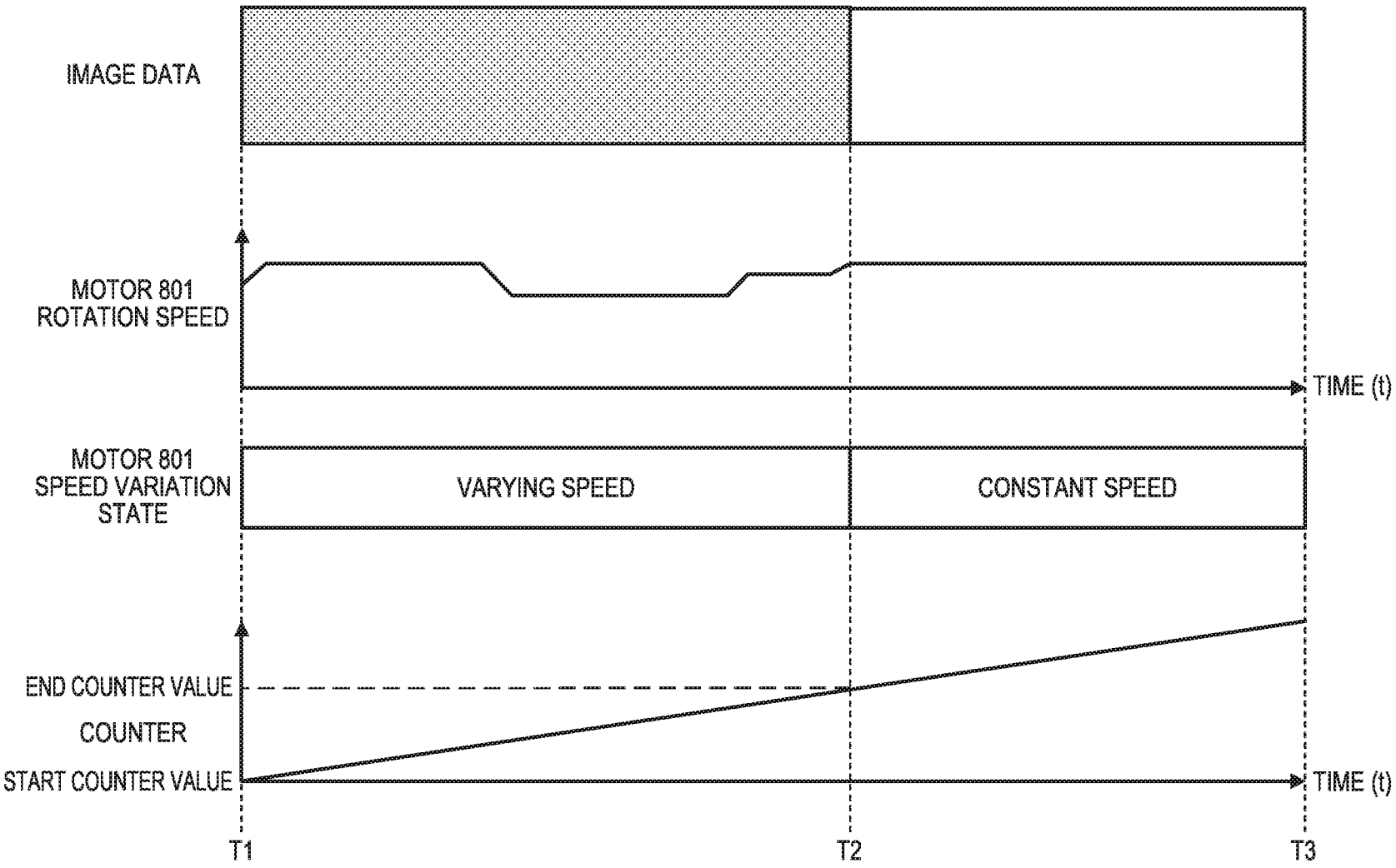
FIG. 11 is a diagram showing a rotation speed of a motor and a counter value in sheet conveyance control according to an embodiment.

FIG. 11 shows temporal change in the rotation speed of the motor 801 during reading of an image by the image reading unit 110. A time T1 is the timing of FIG. 10C, that is, the reading start timing. As shown in FIG. 10B, the warp control has already been started. A time T2 is the timing of FIG. 10D, that is, the variation end timing. A time T3 is not illustrated in FIGS. 10A to 10D, and is the reading end timing.

In the present embodiment, the fixing control unit 900 notifies the recording unit 304 of the variation start timing and the variation end timing. In the present embodiment, the variation start timing is notified to the recording unit 304 before the reading start timing is notified from the reading control unit 303. In this case, as shown in FIG. 11, the recording unit 304 records the counter value of a timing at which the reading start timing is notified, that is, 0 as a start counter value indicating the start of the speed variation period. When the variation end timing is notified, the recording unit 304 records the counter value at that time as the end counter value, as shown in FIG. 11. Then, the recording unit 304 notifies the determination unit 305 of the variation period information which indicates the speed variation period. The processing in the determination unit 305 is similar to that in the first embodiment.

As described above, in the present embodiment, even when the fixing control unit 900 performs the speed variation control of the sheet P, it is possible to determine whether or not an image defect has occurred with good accuracy based on an image read by the image reading unit 110.

Third Embodiment

Figure 12:
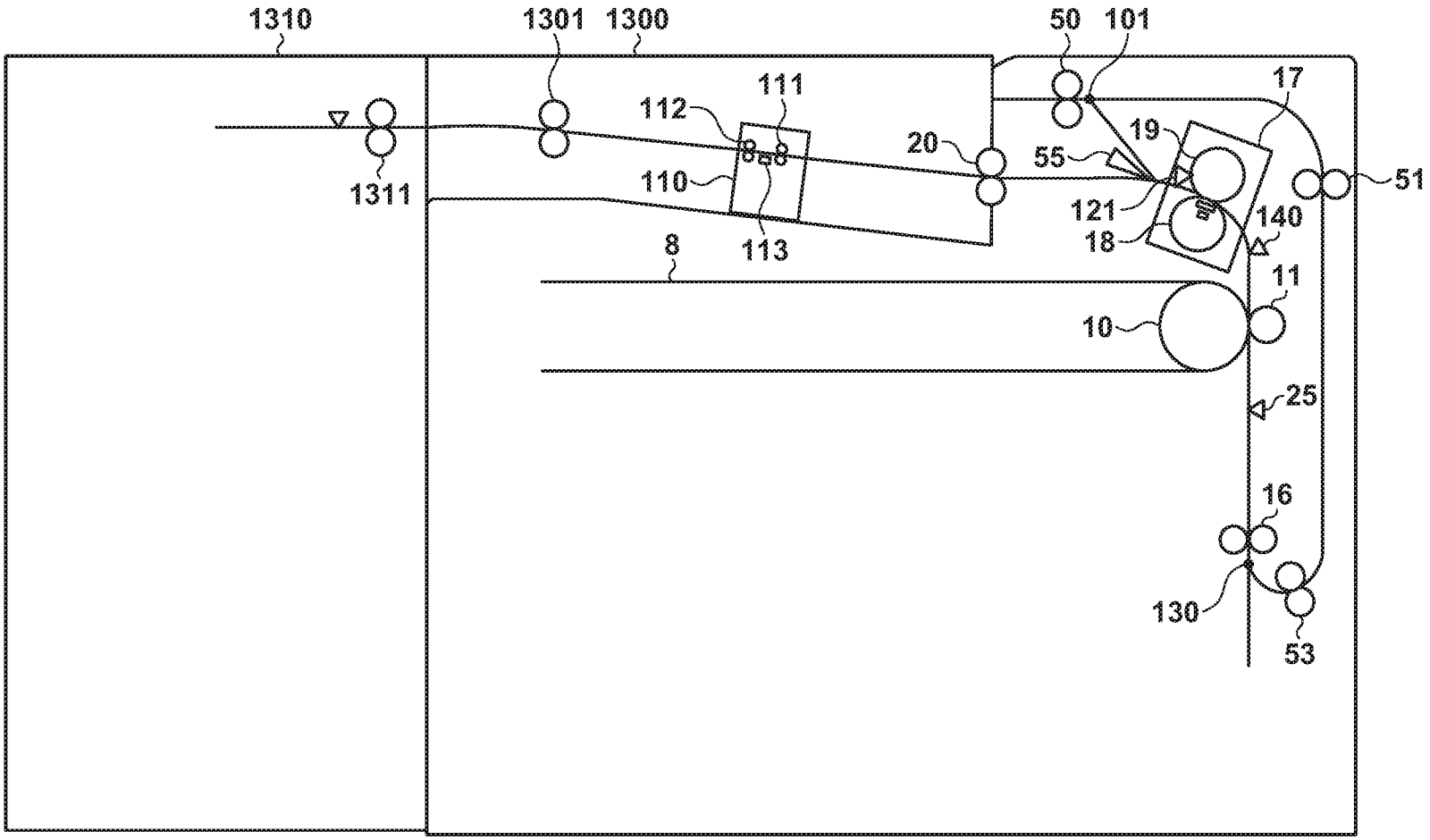
FIG. 12 is a configuration diagram of an image forming apparatus according to an embodiment.

Next, a third embodiment will be described focusing on differences from the first embodiment and the second embodiment. FIG. 12 illustrates an image forming apparatus according to the present embodiment. To simplify the figure, some of the constituent elements described in the first embodiment and the second embodiment are omitted. The image forming apparatus of the present embodiment is provided by adding an intermediate conveyance apparatus 1300 and a post-processing apparatus 1310 to the image forming apparatus described in the first embodiment and the second embodiment. The intermediate conveyance apparatus 1300 is an apparatus that conveys a sheet P discharged by the discharge rollers 20 to the post-processing apparatus 1310. The post-processing apparatus 1310 is an apparatus that performs stacker processing, binding processing, matching processing, or the like on the sheet P on which an image is formed. In the present embodiment, the intermediate conveyance apparatus 1300 includes intermediate conveyance rollers 1301 that convey the sheet P to the post-processing apparatus 1310. The post-processing apparatus 1310 also has rollers 1311 for taking the sheet P from the intermediate conveyance apparatus 1300 into the post-processing apparatus 1310. In the present embodiment, the image reading unit 110 is provided in the intermediate conveyance apparatus 1300 between the discharge rollers 20 and the intermediate conveyance rollers 1301.

Figure 13:
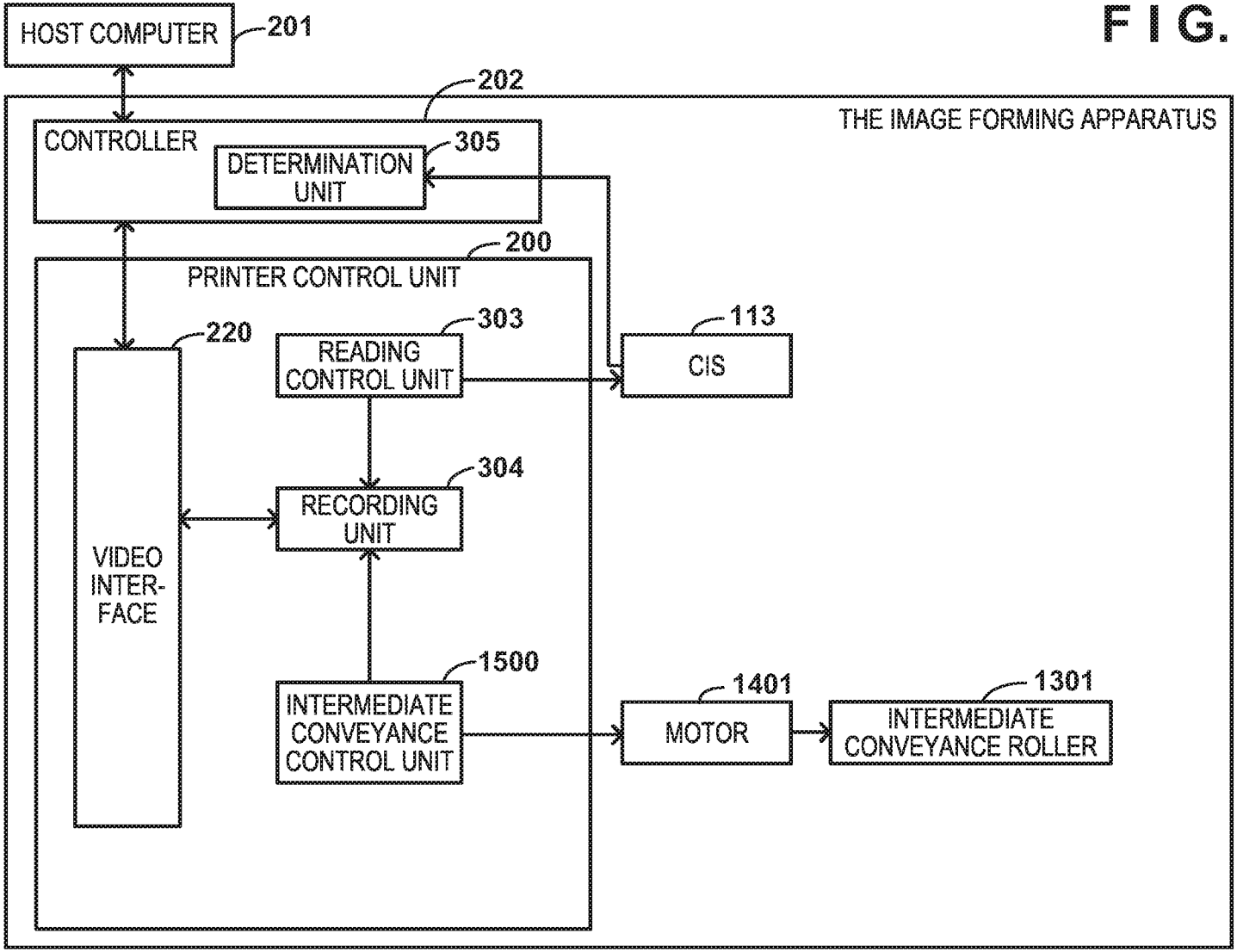
FIG. 13 is a control configuration diagram of an image forming apparatus according to an embodiment.

FIG. 13 is a control configuration diagram of an image forming apparatus according to the present embodiment. FIG. 13 shows only portions necessary for the description of the present embodiment. Description of constituent elements described in the first embodiment is omitted. An intermediate conveyance control unit 1500 controls a motor 1401 to control the rotation of the intermediate conveyance rollers 1301. When conveying the sheet P to the post-processing apparatus 1310, the intermediate conveyance control unit 1500 performs speed variation control to increase the conveyance speed of the sheet P at a timing when the trailing edge of the sheet P has been released from the discharge rollers 20. The speed variation control is executed so that an interval between sheets P continuously conveyed to the post-processing apparatus 1310 is an interval which is required for processing in the post-processing apparatus 1310.

Figure 14B:
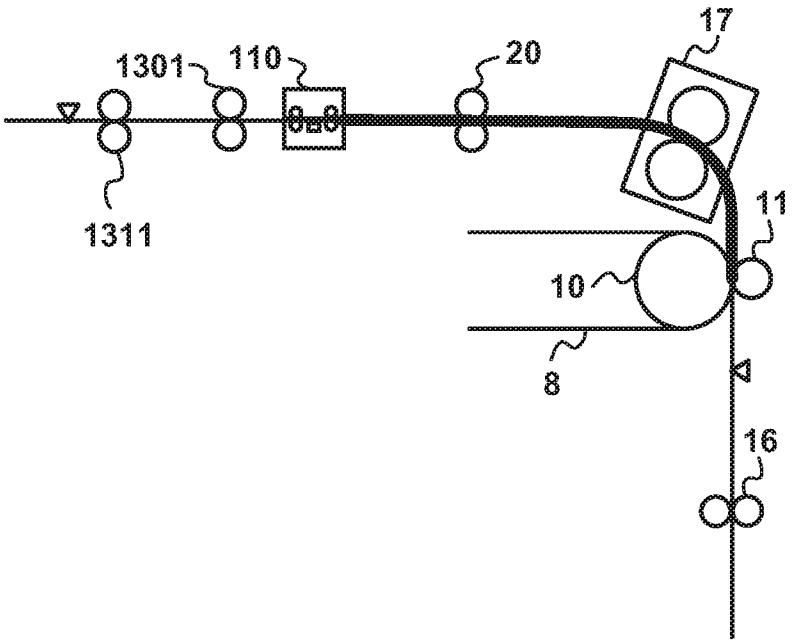
FIG. 14A and FIG. 14B are views for describing sheet conveyance control according to an embodiment.
Figure 14A:
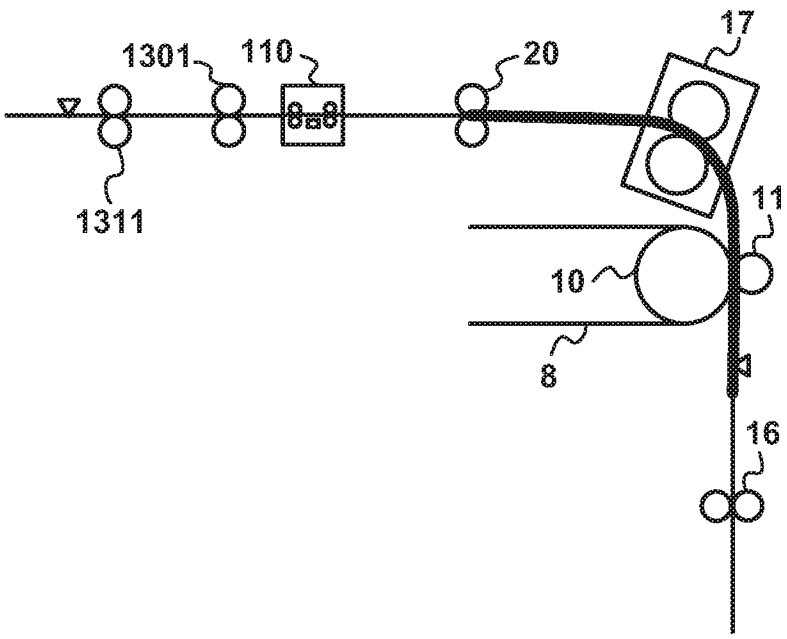
Figure 15B:
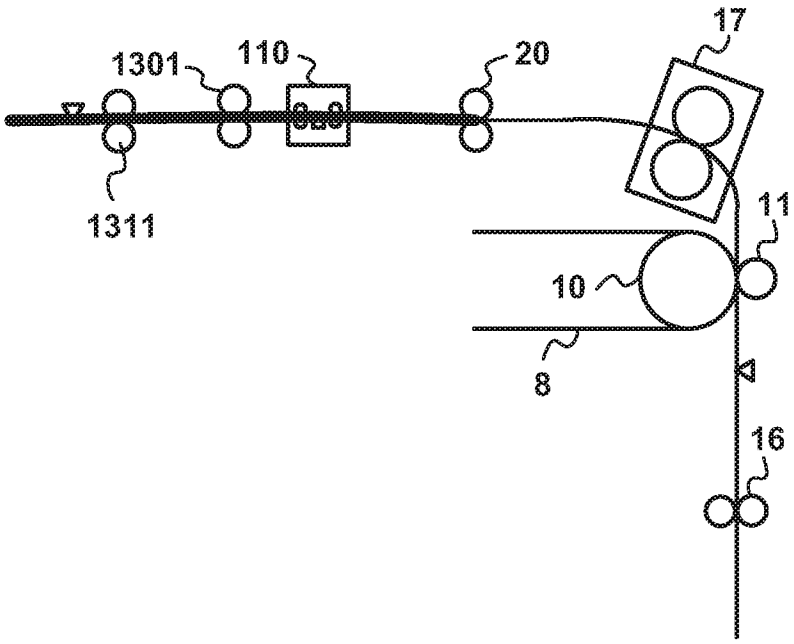
FIG. 15A and FIG. 15B are views for describing sheet conveyance control according to an embodiment.
Figure 15A:
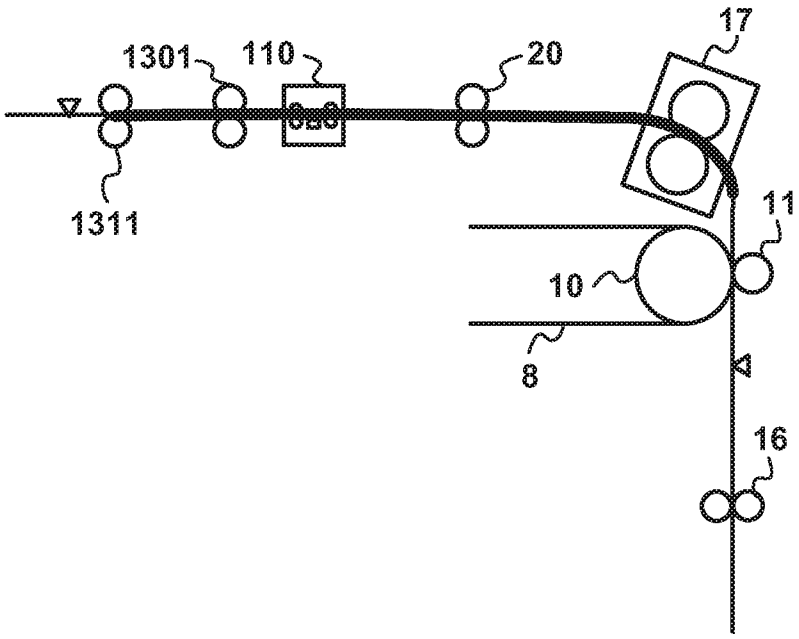

FIG. 14A, FIG. 14B, FIG. 15A, and FIG. 15B are views for describing the sheet conveyance control according to the present embodiment. FIG. 14A shows a timing at which the leading edge of the sheet P has reached the position of the discharge rollers 20. FIG. 14B shows a timing at which the leading edge of the sheet P has reached the image reading unit 110, in other words the reading start timing. The reading control unit 303 determines the reading start timing based on the conveyance distance of the sheet P after the sensor 121 detects the sheet P. FIG. 15A shows a timing at which the leading edge of the sheet P has reached the rollers 1311 of the post-processing apparatus 1310. FIG. 15B shows a timing at which the trailing edge of the sheet P has been released from the discharge rollers 20. From this timing, the intermediate conveyance control unit 1500 starts speed variation control for increasing the conveyance speed of the sheet P. That is, FIG. 15B shows the variation start timing. The intermediate conveyance control unit 1500 determines the variation start timing based on the conveyance distance of the sheet P after the sensor 121 detects the sheet P, and notifies the recording unit 304 of the variation start timing.

Figure 16:
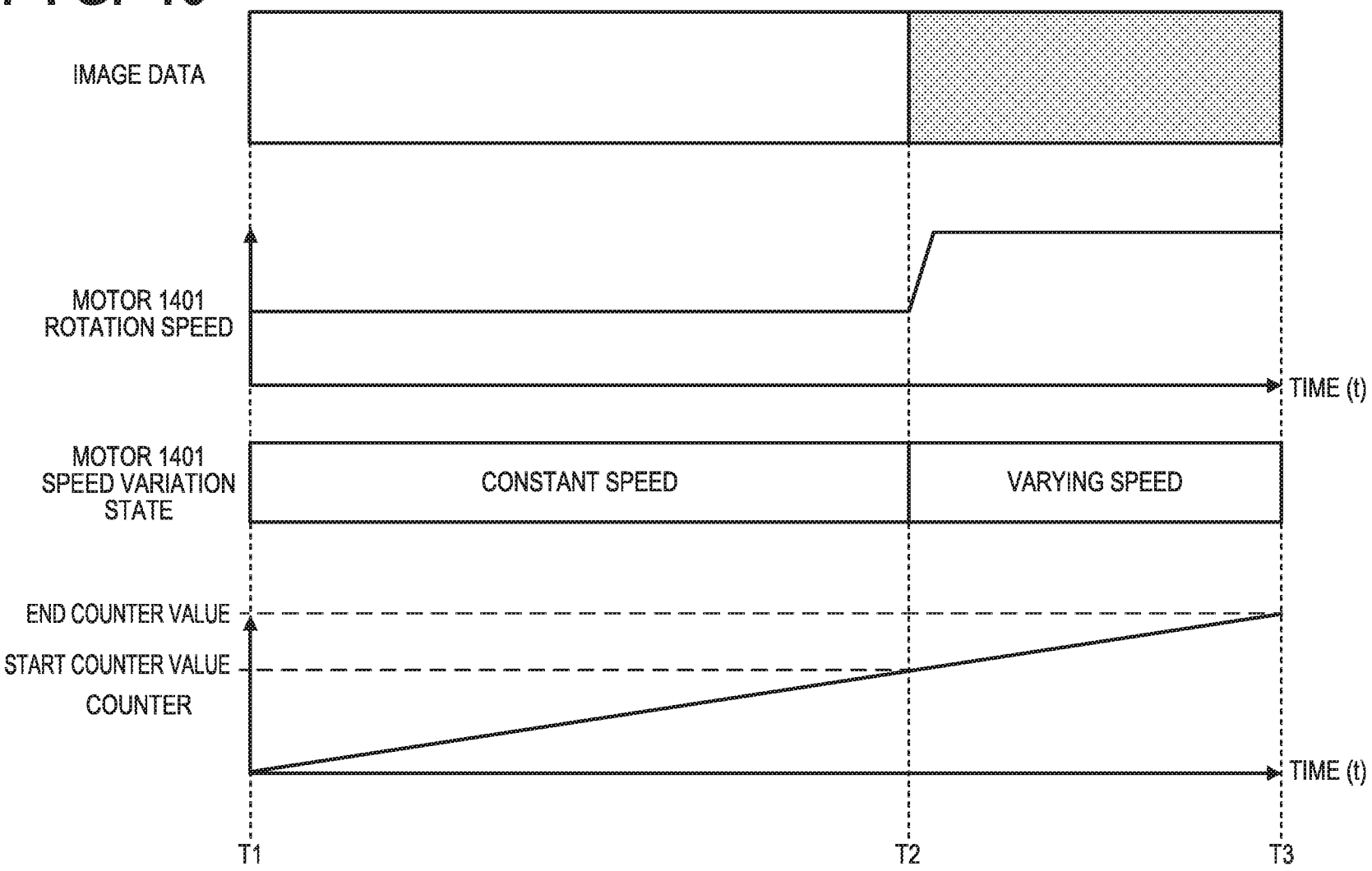
FIG. 16 is a diagram showing a rotation speed of a motor and a counter value in sheet conveyance control according to an embodiment.

FIG. 16 shows temporal change in the rotation speed of the motor 1401 during reading of an image by the image reading unit 110. A time T1 is the timing of FIG. 14B, that is, the reading start timing. A time T2 is the timing of FIG. 15B, that is, the variation start timing. A time T3 is not illustrated in FIGS. 14A, 14B, 15A and 15B, and is the reading end timing. At the reading end timing, the speed variation control continues.

In the present embodiment, the intermediate conveyance control unit 1500 notifies the recording unit 304 of the variation start timing and the variation end timing. In the present embodiment, when the reading end timing is notified from the reading control unit 303, since the speed variation control is in progress, the recording unit 304 records the counter value for the timing at which the reading end timing is notified as the end counter value, as shown in FIG. 16. When the variation start timing is notified, the recording unit 304 records the counter value at that time as the start counter value. Then, the recording unit 304 notifies the determination unit 305 of the variation period information which indicates the speed variation period. The processing in the determination unit 305 is similar to that in the first embodiment.

As described above, in the present embodiment, even when the intermediate conveyance control unit 1500 performs the speed variation control of the sheet P, it is possible to determine whether or not an image defect has occurred with good accuracy based on an image read by the image reading unit 110.

In the above described embodiments, the image reading unit 110 reads an image of the sheet P while the speed variation control is performed. However, the present invention is not limited to such a configuration. For example, the image reading unit 110 may cease reading an image of the sheet P temporarily while the speed variation control is performed. This may be performed by stopping power supply to the CIS 113. Further, this may be performed by turning off a light source included in the image reading unit 110.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-085790, filed on Apr. 26, 2019, which is hereby incorporated by reference herein in its entirety.

What is claimed is:

1. An image forming apparatus comprising:

a conveying unit configured to convey a sheet;

an image forming unit configured to form an image on the sheet;

a reading unit configured to read the image formed on the sheet by the image forming unit during a period in which the sheet is being conveyed by the conveying unit;

a control unit configured to control a conveyance speed of the sheet by the conveying unit; and a determination unit configured to determine whether or not there is an image defect in the image formed on the sheet by the image forming unit based on image data of a first partial image read by the reading unit, excluding a second partial image passing through the reading unit during a speed variation period in which the control unit varies the conveyance speed of the sheet.

2. The image forming apparatus according to claim 1, further comprising a recording unit configured to record a start timing of the speed variation period and an end timing of the speed variation period and notify the determination unit of the start timing and the end timing.

3. The image forming apparatus according to claim 2, wherein the determination unit has a first counter, the recording unit has a second counter synchronized with the first counter, and the recording unit is configured to notify the determination unit of a start counter value which is a counter value of the second counter at the start timing and an end counter value which is a counter value of the second counter at the end timing.

4. The image forming apparatus according to claim 3, wherein the first counter and the second counter are configured to start counting at a timing when the reading unit starts reading the image.

5. The image forming apparatus according to claim 4, wherein, when the start timing is earlier than a timing at which the reading unit starts reading the image, the recording unit is configured to set the counter value of the second counter at the timing at which the reading unit starts reading the image as the start counter value.

6. The image forming apparatus according to claim 4, wherein the first counter and the second counter are configured to stop counting at a timing when the reading unit ends reading the image.

7. The image forming apparatus according to claim 6, wherein, when the end timing is later than a timing at which the reading unit ends reading the image, the recording unit is configured to set the counter value of the second counter at the timing at which the reading unit ends reading the image as the end counter value.

8. The image forming apparatus according to claim 3, wherein every time a part of the image of the sheet is read, the reading unit outputs partial data of the read part of the image to the determination unit, and the determination unit is configured to associate a counter value of the first counter when the partial data is inputted with the partial data, and determine the partial data associated with a counter value that is between the start counter value to the end counter value notified from the recording unit as image data of the second partial image.

9. The image forming apparatus according to claim 1, wherein the image forming unit is configured to form the image on the sheet by transferring the image which has been formed on an image carrier to the sheet at a transfer position, the conveying unit has a first conveyance path for conveying the sheet in a range that includes the transfer position, and a second conveyance path for conveying the sheet, in relation to a conveyance direction of the sheet in the first conveyance path, from a first position of the first conveyance path downstream of the transfer position to a second position of the first conveyance path upstream of the transfer position, the reading unit is configured to read the image of the sheet that is being conveyed along the second conveyance path, and the control unit is configured to, when the sheet is conveyed from the second conveyance path to the transfer position via the second position, vary the conveyance speed to adjust a timing at which the sheet reaches the transfer position.

10. The image forming apparatus according to claim 1, wherein the image forming unit is configured to form the image on the sheet by transferring the image which has been formed on an image carrier to the sheet at a transfer position, the image forming apparatus further includes a fixing unit configured to fix, to the sheet, the image transferred to the sheet at the transfer position, the reading unit is configured to read the image of the sheet downstream of the fixing unit in the conveyance direction of the sheet, and the control unit is configured to vary the conveyance speed in order to cause warp of the sheet between the fixing unit and the transfer position in a period from when a leading edge of the sheet reaches the fixing unit to when a trailing edge of the sheet passes the transfer position in the conveyance direction.

11. The image forming apparatus according to claim 1, further comprising:

a post-processing apparatus configured to perform post-processing of the sheet on which the image is formed by the image forming unit, wherein the conveying unit has a conveyance path for conveying the sheet on which the image is formed by the image forming unit to the post-processing apparatus, the reading unit is configured to read the image of the sheet that is being conveyed along the conveyance path, and the control unit is configured to vary the conveyance speed in order to adjust an interval between a plurality of sheets conveyed to the post-processing apparatus.

12. An image forming apparatus comprising:

a conveying unit configured to convey a sheet;

an image forming unit configured to form an image on the sheet;

a reading unit configured to read the image formed on the sheet by the image forming unit during a period in which the sheet is being conveyed by the conveying unit;

a control unit configured to control a conveyance speed of the sheet by the conveying unit; and a determination unit configured to determine, based on image data of the image read by the reading unit, whether the image formed on the sheet by the image forming unit has an image defect, wherein the determination unit is further configured to determine, based on an image defect that is a determination target, whether or not to use, from among the image data of the image read by the reading unit, first partial data read by the reading unit during a speed variation period in which the control unit varies the conveyance speed of the sheet in the determination.

13. The image forming apparatus according to claim 12, wherein the determination unit is configured to, in a case of making a determination of an image defect in which a streak is generated in the image formed on the sheet, determine that the first partial data is not to be used for the determination.

14. The image forming apparatus according to claim 12, wherein the determination unit is configured to, in a case of making a determination of an image defect in which toner adheres to a region in the sheet in which the image is not formed, determine that the first partial data is to be used for the determination.

* * * * *